US008642524B2

(12) United States Patent
Haigh et al.

(10) Patent No.: US 8,642,524 B2
(45) Date of Patent: Feb. 4, 2014

(54) SOOT CONTROL FOR DIESEL ENGINE LUBRICANTS

(71) Applicant: ExxonMobil Research and Engineering Company, Annandale, NJ (US)

(72) Inventors: Heather M. Haigh, Philadelphia, PA (US); Brandon Thomas Weldon, Baton Rouge, LA (US); Jason Zhisheng Gao, Rose Valley, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 13/649,491

(22) Filed: Oct. 11, 2012

(65) Prior Publication Data

US 2013/0045905 A1 Feb. 21, 2013

Related U.S. Application Data

(63) Continuation of application No. 11/717,343, filed on Mar. 13, 2007, now abandoned.

(60) Provisional application No. 60/788,213, filed on Mar. 31, 2006.

(51) Int. Cl.

| | |
|---|---|
| ***C10M 119/02*** | (2006.01) |
| ***C10M 143/04*** | (2006.01) |
| ***C10M 143/02*** | (2006.01) |

(52) U.S. Cl.

USPC ..... 508/591; 585/1; 585/10; 585/13; 208/18; 208/19

(58) Field of Classification Search

USPC ..... 508/131, 13, 507, 591; 208/18, 19; 585/1, 10, 13

See application file for complete search history.

(56) References Cited

U.S. PATENT DOCUMENTS

| | | | | |
|---|---|---|---|---|
| 6,458,750 | B1 * | 10/2002 | Dardin et al. | 508/501 |
| 2003/0100453 | A1 * | 5/2003 | O'Rear | 508/110 |
| 2004/0048753 | A1 * | 3/2004 | Ritchie et al. | 508/232 |
| 2005/0279669 | A1 * | 12/2005 | Schaberg | 208/15 |
| 2006/0052255 | A1 * | 3/2006 | Abraham et al. | 508/291 |
| 2006/0189492 | A1 * | 8/2006 | Bera et al. | 508/570 |
| 2006/0205610 | A1 * | 9/2006 | Rosenbaum et al. | 508/110 |
| 2007/0138053 | A1 * | 6/2007 | Baillargeon | 208/19 |

OTHER PUBLICATIONS

Lubricant Additives Chemistry and Applications, Leslie R. Rudnick CRC Press 2003 pp. 293-327 ISBN 978-0-8247-0857-3.*

* cited by examiner

*Primary Examiner* — Pamela H Weiss
(74) *Attorney, Agent, or Firm* — Robert A. Migliorini

(57) ABSTRACT

The present invention is directed to a method for controlling soot induced viscosity increase in diesel engines, by using as the diesel engine lubricant an oil formulation comprising a base oil containing about 10 to 80 wt % GTL base stock and/or base oil and/or hydrodewaxed or hydroisomerized/catalytic (or solvent) dewaxed base stock and/or base oil in combination with 20 to 90 wt % conventional Group I petroleum derived base oil, said base oil being further combined with a polymeric viscosity modifier, and to the lubricating oil which effects such control over soot induced viscosity increase.

14 Claims, 3 Drawing Sheets

SOOT CONTROL FOR DIESEL ENGINE LUBRICANTS

CROSS REFERENCE TO RELATED APPLICATIONS

This application is a continuation of U.S. patent application Ser. No. 11/717,343 filed Mar. 13, 2007 which claims the benefit of U.S. Provisional Application No. 60/788,213 filed Mar. 31, 2006.

BACKGROUND OF THE INVENTION

1. Field of the Invention

The present invention relates to diesel engine lubricating oils and to the control of soot induced viscosity increase of the lubricating used in such engines.

2. Description of the Related Art

Internal combustion engines function by the combustion of fuels which in turn generate the power needed to propel vehicles. In the case of a diesel engine, the fuel is a diesel fuel and the combustion thereof generally results in emissions from the exhausts of such vehicles which comprise three main components. These are: soot and particulate matter, carbon monoxide and nitrogen oxides (the latter will hereafter be abbreviated as NOx for convenience). To alleviate environmental concerns, research is ongoing to reduce the levels of these emissions. NOx emission can be reduced by lowering the temperature at which the fuel is combusted in the engine. Typically this is achieved by retarding the combustion, i.e., by injecting the fuel shortly after the peak temperature is reached in the cylinder. However, this retarded combustion has the disadvantage that it causes more soot to accumulate in the engine lubricant partly due to incomplete combustion of the fuel because of the lower combustion temperature, and partly due to increased soot deposition on the cylinder wall which is drawn down into the lubricant with the downward stroke of the piston. The presence of soot in the lubricant has the adverse affects of causing viscosity increase and accelerated wear. It is important that soot induced viscosity increase be controlled such that the lubricant stays within viscosity grade in order to maintain its expected performance and to enable quick and clean drainage of the engine during servicing.

The formation of soot may be alleviated to a significant extent by operating the diesel engine at relatively higher temperatures. However, the higher temperatures whilst mitigating the formation of soot also result in the formation of increased amounts of NOx. If, however, the engine temperature is towered, incomplete combustion ensues and whilst this reduces the amount of NOx formed in the emissions, it also substantially increases the amount of soot generated. The soot so formed can manifest itself in two ways. It can either appear as a thick black smoke emitted from the exhaust of the vehicle or can be accumulated in the engine lubricant. As the soot builds up in the lubricant, the latter becomes more and more viscous and upon reaching a critical value can cause gelation of the lubricant and may eventually cause seizure of the engine.

Several methods have been put forward to alleviate this problem including the use of one or more of dispersants, metal salts and solvents which may be ethers, esters and the like. The dispersants function by forming a coating of the dispersant on the surface of soot particles and thereby minimizing the tendency of the soot particles to agglomerate. However, the potency of the dispersants to perform this function, in turn, declines with time and thus, one of the methods of improving the useful life of lubricants, particularly crankcase lubricants, would be to improve the dispersancy retention capability of crankcase lubricants. This may be achieved, e.g., by minimizing the risk of oxidation of the dispersants under the conditions prevalent in the engines during use. One such method is described in U.S. Pat. No. 5,837,657 which discloses a method of improving the performance of a sooted diesel oil and controlling soot induced viscosity increase by adding to the diesel oil a minor amount of a trinuclear molybdenum compound of the generic formula $MO_3S_kL_nQ_z$ wherein L is a ligand having organo groups, n is from 1 to 4, k various from 4 through 10, Q is a neutral electron donating compound such as, e.g., water, amines, alcohols, phosphines and ethers, and z ranges from 0 to 5.

Hydrocarbon base oils have differing solvency characteristics that affect their capability to solubilize performance additives. Highly paraffinic hydrocarbon base oils (those having low levels of aromaticity) are known to have low-to-poor additive solubility characteristics. For example, such low-solvency hydrocarbon base oils include polyalpha olefins (PAO) which are 100% isoparaffinic and have essentially 0% aromatics content. Similarly, wax isomerate base oils, in particular hydroisomerized Fischer-Tropsch (F-T) waxes, often called Gas-to-Liquids (GTL) lubricant base oils, are very highly paraffinic and have essentially 0% aromatics content. The base stock is derived from a waxy, F-T synthesized hydrocarbon feed fraction comprising hydrocarbons having an initial b.p. in the range of approximately 650-750° F., by a process which comprises hydroisomerizing the feed and optionally dewaxing the isomerate. The lubricant also contains hydrocarbonaceous and synthetic base stock material in mixture with the F-T derived base stock. Consequently, such wax isomerate base oils would be expected to have low solvency and poor additive solubility performance.

High isoparaffinic base stocks, however, are advantageous in soot control for diesel engine lubricants. Lower soot-induced viscosity increase and lower soot-induced wear are observed for diesel engine lubricants with higher saturate contents. In addition, GTL base oils are essentially sulfur-free, which is highly desirable for the next generation engine lubricants such as GF-5 and PC-10. In these new engine lubricant categories, a maximum sulfur level is defined for improved compatibility with new low emission engines equipped with aftertreatment devices.

It would be advantageous if a way could be found to reduce the soot induced viscosity increase experienced in diesel engine lubricating oils during use while not negatively affecting the desired viscosity modifying effect of polymeric viscosity modifier which are normally added to diesel engine lubricating oils without the need of employing cosolvents.

DESCRIPTION OF THE INVENTION

Figure 1:
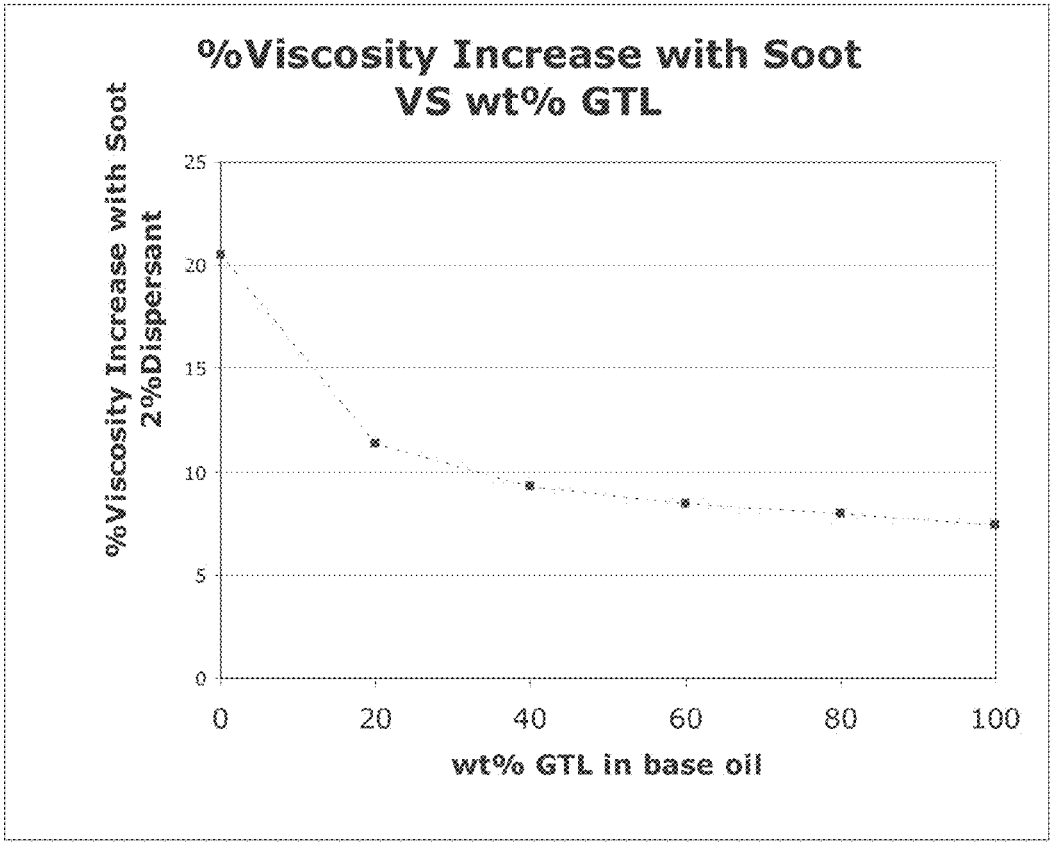
FIG. 1 shows the relationship between % viscosity increase due to soot and the GTL content of the base oil.

The present invention is directed to a method for controlling the soot induced viscosity increase of conventional/mineral oil derived base oil lubricating oil used in diesel engines while not adversely affecting the viscosity modifying effect of viscosity improver added to diesel engine lubricating oils.

It has been discovered that the soot induced viscosity increase of diesel engine conventional petroleum/mineral oil derived base stock or base oil lubricating oils can be controlled in the diesel engine by adding to the diesel engine lubricant comprising a conventional petroleum/mineral oil derived base stock or base oil about 10 to 80 wt %, preferably about 10 to 70 wt %, more preferably about 20 to 60 wt % of a GTL base stock and/or base oil and/or hydrodewaxed or hydroisomerized/catalytic (or solvent) dewaxed base stock or base oil based on the total base oil. The soot induced viscosity increase of diesel engine lubricating engine oils during use can be controlled by employing as the diesel engine lubricating oil a formulation comprising a base stock or base oil containing about 10 to 80 wt %, preferably about 10 to 70 wt %, more preferably about 20 to 60 wt % of a GTL base stock and/or base oil and/or hydrodewaxed or hydroisomerizad/catalytic (or solvent) dewaxed base stock and/or base oil in combination with about 90 to 20 wt %, preferably about 90 to 30 wt %, more preferably about 90 to 40 wt % of a conventional petroleum/mineral oil derived base stock or base oil based on the weight of the total base oil.

It has been discovered that the addition of the GTL base stock(s) and/or base oil(s) and/or hydrodewaxed or hydroisomerized/catalytic (or solvent) dewaxed base stock(s) or base oil(s) in the amount indicated to the conventional petroleum/mineral oil derived base stock(s) or base oil(s) results in a base oil which exhibits both the ability to control soot induced viscosity increase while not adversely affecting the desirable viscosity modifying effect of polymeric viscosity modifiers which are deliberately added to the diesel engine lubricating oil formulation.

Thus the present invention is directed to a method for controlling soot induced viscosity increase in diesel engine lubricating oil during use by using as the diesel engine lubricant an oil formulation comprising a base stock or base oil containing about 10 to 80 wt %, preferably about 10 to 70 wt %, more preferably about 10 to 60 wt % of one or more GTL base stock(s) and/or base oil(s) and/or hydrodewaxed or hydroisomerized/catalytic (or solvent) dewaxed base stock(s) or base oil(s), preferably GTL base stock in combination with about 90 to 20 wt %, preferably about 90 to 30 wt %, more preferably about 90 to 40 wt % of a conventional, petroleum/mineral oil derived base stock or base oil.

The GTL base stock(s) and/or base oil(s) and/or hydrodewaxed or hydroisomerizaed/catalytic (or solvent) dewaxed base stock(s) and/or base oil(s) is (are) characterized as having a kinematic viscosity at 100° C. in the range of about 2 to 50 $mm^2/s$, preferably about 3 to 40 $mm^2/s$, more preferably about 3.5 to 30 $mm^2/s$.

The conventional petroleum/mineral oil derived base stock or base oil is preferably a Group I and/or Group II base stock, more preferably Group I base stock. Groups I and II are broad categories of base oil stocks developed and defined by the American Petroleum Institute (API Publication 1509; www.APL.org) to create guidelines for lubricant base oils Group I base stocks generally have a viscosity index of between about 80 to 120 and contain greater than about 0.03 wt % sulfur and less than about 90 wt % saturates, Group II base stocks generally have a viscosity index of between about 80 to 120 and contain less than or equal to about (103 wt % sulfur and grater than or equal to about 90 wt % saturates. The conventional/mineral oil derived base stock or base oil used in the present invention has a kinematic viscosity at 100° C. in the range of about 2 to 20 $mm^2/s$, preferably about 4 to 10 $mm^2s$, more preferably about 4 to 8 $mm^2/s$. The blend of the GTL base stock(s) and/or base oil(s) and/or hydrodewaxed or hydroisomerized/catalytic (or solvent) dewaxed base stock(s) or base oil(s) with the conventional petroleum/mineral oil derived base stock or base oil preferably exhibits an unadditized kinematic viscosity at 100° C. in the range of about 4 to 12 $mm^2/s$, preferably 4 to 10 $mm^2/s$, more preferably 4 to 8 $mm^2/s$ while the fully formulated lubricating oil composition made using the base oil exhibits a kinematic viscosity at 100° C. in the range of about 6 to 14 $mm^2/s$.

The present invention is also directed to a diesel engine lubricating oil formulation comprising a base oil containing about 10 to 80 wt %, preferably about 10 to 70 wt %, more preferably about 10 to 60 wt % of one or more GTL base stock(s) and/or base oil(s) and/or hydrodewaxed or hydroisomerized/-catalytic (or solvent) dewaxed base stock(s) and/or base oil(s) in combination with about 90 to 20 wt %, preferably about 90 to 30 wt %, more preferably about 90 to 40 wt % of a conventional, petroleum/mineral oil derived base stock or base oil, preferably a Group I and/or Group II base stock and a polymeric viscosity modifying additive in an amount in the range of about 1 to 25 wt % on an as received basis, preferably about 5 to 25 wt % on an as received basis based on the total weight of the formulated diesel engine lubricating oil composition.

Viscosity modifiers (also known as VI improvers and viscosity index improvers) provide lubricants with high and low temperature operability. These additives impart shear stability at elevated temperatures and acceptable viscosity at low temperatures.

Suitable viscosity index improvers include high molecular weight (polymeric) hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. A suitable viscosity index improver is polymethacrylate (copolymers of various chain length alkyl methacrylates, for example), some formulations of which also serve as pour point depressants. Polyisobutylene is another example of a suitable viscosity index improver. Other suitable viscosity index improvers include copolymers of ethylene and propylene, hydrogenated block copolymers of styrene and isoprene, or styrene and butadiene, and polyacrylates (copolymers of various chain length acrylates, for example). Specific examples include olefin copolymer and styrene-hydrogenated isoprene copolymer of 50,000 to 200,000 molecular weight.

As previously indicated, viscosity modifiers are used in an amount of about 1 to 25 wt % on an as received basis, preferably about 5 to 25 wt % on an as-received basis.

Because viscosity modifiers are usually supplied diluted in a carrier or diluent oil and constitute anywhere from about 5 to 50 wt % active ingredient in the additive concentrates as received from the manufacturer, the amount of viscosity modifiers used in the formulation on an active ingredient basis can also be expressed as being in the range of about 0.20 to about 4.0 wt % active ingredient, preferably about 0.3 to 2.5 wt % active ingredient. For olefin copolymer and styrene-hydrogenated isoprene copolymer viscosity modifier, the active ingredient is in the range of about 5 to 15 wt % in the additive concentrates from the manufacturer, the amount of these viscosity modifiers used in the formulation can also be expressed as being in the range of about 0.20 to 1.9 wt % active ingredient, preferably about 0.3 to 1.5 wt % active ingredient.

Preferably the conventional, petroleum/mineral oil derived Group I base stock or base oil has a sulfur content of about 0.2 wt % sulfur or base, more preferably about 0.15 wt % sulfur or less, even more preferably about 0.1 wt % sulfur or less.

The GTL base stock(s) and/or base oil(s) and/or hydrodewaxed or hydroisomerized/catalytic (or solvent) dewaxed base stock(s) and/or base oil(s) useful in the present invention include one or more or a mixture of base stock(s) and/or base oil(s) derived from one or more Gas-to-Liquids (GTL) materials, as well as hydrodewaxed, or hydroisomerized/conventional cat (or solvent) dewaxed base stock(s) and/or base oils derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks and/or base oils.

As used herein, the following terms have the indicated meanings:

a) "wax"—hydrocarbonaceous material having a high pour point, typically existing as a solid at room temperature, i.e., at a temperature in the range from about 15° C. to 25° C., and consisting predominantly of paraffinic materials;

b) "paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;

c) "hydroprocessing": a refining process in which a feedstock is heated with hydrogen at high temperature and under pressure, commonly in the presence of a catalyst, to remove and/or convert less desirable components and to produce an improved product;

d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

e) "catalytic dewaxing": a conventional catalytic process in which normal paraffins (wax) and/or waxy hydrocarbons, e.g., slightly branched iso-paraffins, are converted by cracking/fragmentation into lower molecular weight species to insure that the final oil product (base stock or base oil) has the desired product pour point;

f) "hydroisomerization" (or isomerization): a catalytic process in which normal paraffins (wax) and/or slightly branched iso-paraffins are converted by rearrangement/isomerization into branched or more branched iso-paraffins (the isomerate from such a process possibly requiring a subsequent additional wax removal step to ensure that the final oil product (base stock or base oil) has the desired product pour point);

g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

h) "hydrodewaxing": (e.g., ISODEWAXING® of Chevron or MSDW™ of Exxon Mobil corporation) a very selective catalytic process which in a single step or by use of a single catalyst or catalyst mixture effects conversion of wax by isomerization/rearrangement of the n-paraffins and slightly branched isoparaffins into more heavily branched isoparaffins, the resulting product not requiring a separate conventional catalytic or solvent dewaxing step to meet the desired product pour point;

i) the terms "hydroisomerate", "isomerate", "catalytic dewaxate", and "hydrodewaxate" refer to the products produced by the respective processes, unless otherwise specifically indicated;

j) "base stock" is a single oil secured from a single feed stock source and subjected to a single processing scheme and meeting a particular specification;

k) "base oil" is a mixture of base stocks.

Thus the term "hydroisomerization/cat dewaxing" is used to refer to catalytic processes which have the combined effect of converting normal paraffins and/or waxy hydrocarbons by rearrangement/isomerization, into more branched iso-paraffins, followed by (1) catalytic dewaxing to reduce the amount of any residual n-paraffins or slightly branched iso-paraffins present in the isomerate by cracking/fragmentation or by (2) hydrodewaxing to effect further isomerization and very selective catalytic dewaxing of the isomerate, to reduce the product pour point. When the term "(or solvent)", is included in the recitation, the process described involves hydroisomerization followed by solvent dewaxing which effects the physical separation of wax from the hydroisomerate so as to reduce the product pour point.

GTL materials are materials that are derived via one or more synthesis, combination, transformation, rearrangement, and/or econstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oil(s) include oils boiling in the tube oil boiling range separated/fractionated from synthesized GTL materials such as for example, by distillation and subsequently a final wax processing step which is either the well-known catalytic dewaxing process, or solvent dewaxing process, to produce lube oils of reduced/low pour point; synthesized wax isomerates, comprising, for example, hydrodewaxed, or hydroisomerized/cat (or solvent) dewaxed synthesized waxy hydrocarbons; hydrodewaxed, or hydroisomerized/cat (or solvent) dewaxed Fischer-Tropsch (F-T) material (i.e., hydrocarbons, waxy hydrocarbons, waxes and possible analogous oxygenates); preferably hydrodewaxed, or hydroisomerized/cat (or solvent) dewaxed F-T hydrocarbons, or hydrodewaxed or hydroisomerized/cat (or solvent) dewaxed, F-T waxes, hydrodewaxed, or hydroisomerized/cat (or solvent) dewaxed synthesized waxes, or mixtures thereof.

GTL base stock(s) and/or base oil(s) derived from GTL materials, especially, hydrodewaxed, or hydroisomerized/cat (or solvent) dewaxed F-T material derived base stock(s) and/or base oil(s), and other hydrodewaxed, or hydroisomerized/cat (or solvent) dewaxed wax derived base stock(s) and/or base oil(s) are characterized typically as having kinematic viscosities at 100° C. of from about 2 $mm^2/s$ to about 50

$mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the hydrodewaxing or hydroisomerization catalytic (or solvent) dewaxing of F-T wax, which has a kinematic viscosity of about 4 $mm^2/s$ at 100° C. and a viscosity index of about 130 or greater. Preferably the wax treatment process is hydrodewaxing carried out in a process using a single hydrodewaxing catalyst. Reference herein to Kinematic viscosity refers to a measurement made by ASTM method D445.

GTL base stock(s) and/or base oil(s) derived from GTL materials, especially hydrodewaxed, or hydroisomerized/cat (or solvent) dewaxed F-T material derived base stock(s) and/or base oil(s), and other hydrodewaxed, or hydroisomerized/cat (or solvent) dewaxed wax-derived base stock(s) and/or base oil(s), which can be used as base stock and/or base oil components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM 1)97 and similar automated versions.

The GTL base stock(s) and/or base oil(s) derived from GTL materials, especially hydrodewaxed or hydroisomerized/cat (or solvent) dewaxed F-T material derived base stock (s) and/or base oil(s), and other such wax-derived base stock (s) and/or base oil(s) which can be used in this invention are also characterized typically as having viscosity indices of 80 or greater, preferably 100 or greater, and more preferably 120 or greater. Additionally, in certain particular instances, the viscosity index of these base stocks and/or base oil(s) may be preferably 130 or greater, more preferably 135 or greater, and even more preferably 140 or greater. For example, GTL base stock(s) and/or base oil(s) that derive from GTL materials preferably F-T materials especially F-T wax generally have a viscosity index of 130 or greater, References herein to viscosity index refer to ASTM method D2270.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained by the hydroisomerization/isodewaxing of F-T material, especially FT wax, is essentially nil.

In a preferred embodiment, the GTL base stock(s) and/or base oil(s) comprises paraffinic materials that consist predominantly of non-cyclic isoparaffins and only minor amounts of cycloparaffins. These GTL base stock(s) and/or base oil(s) typically comprise paraffinic materials that consist of greater than 60 wt % non-cyclic isoparaffins, preferably greater than 8 wt % non-cyclic isoparaffins, more preferably greater than 85 wt % non-cyclic isoparaffins, and most preferably greater than 9 wt % non-cyclic isoparaffins.

Useful compositions of GTL base stock(s) and/or base oil(s), hydrodewaxed or hydroisomerized/cat (or solvent) dewaxed F-T material derived base stock(s), and wax-derived hydrodewaxed, or hydroisomerized/cat (or solvent) dewaxed base stock(s), such as wax isomerates or hydrodewaxates, are recited in U.S. Pat. Nos. 6,080,301; 6,090,989, and 6,165,949 for example.

Base stock(s) and/or base oil(s) derived from waxy feeds, which are also suitable for use in this invention, are paraffinic fluids of lubricating viscosity derived from hydrodewaxed, or hydroisomerized/cat (or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stock(s) and/or base oil(s).

Slack wax is the wax recovered from any waxy hydrocarbon oil including synthetic oil such as FT waxy oil or petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es) secured from synthetic waxy oils such as F-T waxy oil will usually have zero or nil sulfur and/or nitrogen containing compound content. Slack wax(es) secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base stock and/or base oil and/or wax isomerate base stock and/or base oil as used herein and in the claims is to be understood as embracing individual fractions of GTL base stock and/or base oil and/or of wax-derived hydrodewaxed or hydroisomerized/cat (or solvent) dewaxed base stock and/or base oil as recovered in the production process, mixtures of two or more GTL base stock and/or base oil fractions and/or wax-derived hydrodewaxed, or hydroisomerized/cat (or solvent) dewaxed base stocks/base oil fractions, as well as mixtures of one or two or more low viscosity GTL base stock and/or base oil fraction(s) and/or wax-derived hydrodewaxed, or hydroisomerized/cat (or solvent) dewaxed base stock and/or base oil fraction(s) with one, two or more higher viscosity GTL base stock and/or base oil fraction(s) and/or wax-derived hydrodewaxed, or hydroisomerized/cat (or solvent) dewaxed base stock and/or base oil fraction(s) to produce a dumbbell blend wherein the blend exhibits a kinematic viscosity within the aforesaid recited range.

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) and/or base oil(s) is/are derived is a wax or waxy feed from mineral oil, non-mineral it) oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F. fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking, hydrodewaxing, or hydroisomerizing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (132), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350, These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over the hydrodewaxing catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step.

A dewaxing step, when needed, may be accomplished using one or more of solvent dewaxing, catalytic dewaxing or hydrodewaxing processes and either the entire hydroisomerate or the 650-750° F.+ fraction may be dewaxed, depending on the intended use of the 650-750° F.+ material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing tube oil fraction which is the raffinate. The raffinate is typically further chilled in scraped surface chillers to remove more wax solids. Autorefrigerative dewaxing using low molecular weight hydrocarbons, such as propane, can also be used in which the hydroisomerate is mixed with, e.g., liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention, Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.+, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s) and/or base oil(s), hydrodewaxed, or hydroisomerized/cat (or solvent) dewaxed wax-derived base stock(s) and/or base oil(s), have a beneficial kinematic viscosity advantage over conventional API Group II and Group III base stock(s) and/or base oil(s), and so may be very advantageously used with the instant invention. Such GTL base stock(s) and/or base oil(s) can have significantly higher kinematic viscosities, up to about 20-50 mm$^2$/s at 100° C., whereas by comparison commercial Group II base oils can have kinematic viscosities up to about 15 mm$^2$/s at 100° C., and commercial Group III base oils can have kinematic viscosities up to about 10 mm$^2$/s at 100° C. The higher kinematic viscosity range of GTL base stock(s) and/or base oil(s), compared to the more limited kinematic viscosity range of Group II and Group III base stock(s) and/or base oil(s), in combination with the instant invention can provide additional beneficial advantages in formulating lubricant compositions.

In the present invention mixtures of hydrodewaxate, or hydroisomerate/cat (or solvent) dewaxate base stock(s) and/or base oil(s), mixtures of the GTL base stock(s) and/or base oil(s), or mixtures thereof, preferably mixtures of GTL base stock(s) and/or base oil(s), can constitute all or part of the base oil.

The preferred base stock(s) and/or base oil(s) derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geq 4$), are such that: (a) BI-0.5($CH_2 \geq 4$) >15; and (b) BH+0.85 ($CH_2 \geq 4$) <45 as measured over said liquid hydrocarbon composition as a whole.

The preferred GTL base stock and/or base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred BI≥25.4 and ($CH_2 \geq 4$)≤22.5. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.) <2900 (KY at 100° C.) −7000.

The preferred GTL base stock and/or base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions;

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $C_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch ($CH_2$>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);

b) divide the total carbon-13 integral area (chart divisions or area counts) by the average carbon number from step a. to obtain the integral area per carbon in the sample;

c) measure the area between 29.9 ppm and 29.6 ppm in the sample; and d) divide by the integral area per carbon from step b. to obtain FCI.

Branching measurements can be performed using any Fourier Transform NMR spectrometer. Preferably, the measurements are performed using a spectrometer having a magnet of 7.0T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cyclo-paraffins, which may be present in the oil samples in varying amounts. The cycloparaffins content is measured using Field Ionization Mass Spectroscopy (FIMS).

GTL base stock(s) and/or base oil(s), and hydrodewaxed, or hydroisomerized/cat (or solvent) dewaxed wax base stock (s) and/or base oil(s), for example, hydroisomerized or hydrodewaxed waxy synthesized hydrocarbon, e.g., Fischer-Tropsch waxy hydrocarbon base stock(s) and/or base oil(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stock(s) and/or base oil(s).

For example, low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

The instant invention can be used with additional lubricant components in effective amounts in lubricant compositions, such as for example polar and/or non-polar lubricant base oils, and performance additives such as for example, but not limited to, oxidation inhibitors, metallic and non-metallic dispersants, metallic and non-metallic detergents, corrosion and rust inhibitors, metal deactivators, anti-wear agents (metallic and non-metallic, phosphorus-containing and non-phosphorus, sulfur-containing and non-sulfur types), extreme pressure additives (metallic and non-metallic, phosphorus-containing and non-phosphorus, sulfur-containing and non-sulfur types), anti-seizure agents, pour point depressants, wax modifiers, viscosity modifiers, seal compatibility agents, lubricity agents, anti-staining agents, chromophoric agents, defoamants, demulsifiers, and others. For a review of many commonly used additives see Klamann in Lubricants and Related Products, Verlag Chemie, Deerfield Beach, Fla.; ISBN 0-89573-177-0, which also gives a good discussion of a number of the lubricant additives mentioned below. Reference is also made "Lubricant Additives" by M. W. Ranney, published, by Noyes Data Corporation of Parkridge, N.J. (1978).

The types and quantities of performance additives used in combination with the instant invention in lubricant compositions are not limited, by the examples shown herein as illustrations.

Antiwear and EP Additives

Internal combustion engine lubricating oils require the presence of antiwear and/or extreme pressure (EP) additives in order to provide adequate antiwear protection for the engine. Increasingly specifications for engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithio-phosphate in which the primary metal constituent is zinc, or zinc dialkyidithio-phosphate (ZDDP). ZDDP compounds generally are of the formula, $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithio-carbamate trimer complex ($R{=}C_8$-$C_{18}$ alkyl) are also useful antiwear agents. The use or addition of such materials should be kept to a minimum if the object is to produce low SAP formulations. Each of the aforementioned patents is incorporated by reference herein in its entirety.

Esters of glycerol may be used as antiwear agents. For example, mono-, di-, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties. Each of the aforementioned patents is incorporated herein by reference in its entirety.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothia-diazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example, each of which is incorporated by reference herein in its entirety.

Useful antioxidants include hindered phenols. These phenolic anti-oxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{11}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenykalpha-naphthylamine; phenyl-alphanaphthylamine; and p-octylphenykalpha-naphthylamine Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co, of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

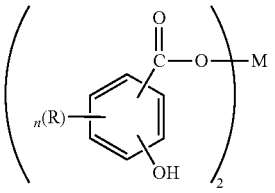

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction, See U.S. Pat. No. 3,595,791 for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, preferably, about 0.1 to 0.4 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless, In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435, Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a to divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433; 3,822,209 and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines Such additives may be used in an amount of about 0.01 to 5 wt %, preferably about 0.01 to 1.5 wt %.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. Sec U.S. Pat. No. 5,824,627; U.S. Pat. No. 6,232,276; U.S. Pat. No. 6,153,564; U.S. Pat. No. 6,143,701; U.S. Pat. No. 6,110,878; U.S. Pat. No. 5,837,657; U.S. Pat. No. 6,010,987; U.S. Pat. No. 5,906,968; U.S. Pat. No. 6,734,150; U.S. Pat. No. 6,730,638; U.S. Pat. No. 6,689,725; U.S. Pat. No. 6,569,820; WO 99/66013; WO 99/47629; WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in the table below, as well as other amounts mentioned in this patent, unless otherwise indicated are directed to the amount of active ingredient (that is the non-solvent portion of the ingredient). The wt % indicated below are based on the total weight of the lubricating oil composition.

TABLE 1

Typical Amounts of Various Lubricant Oil Components

| Compound | Approximate wt % (useful) | Approximate wt % (preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base stock or base oil | Balance | Balance |

EXAMPLES

Example 1

Blends were prepared comprising only GTL 6 of nominal KV 6.0 $mm^2/s$ at 100° C. a mixture of only 150N and 600N Group I base oil the KV of the mixture being nominally 6.0 $mm^2/s$ @ 100° C., and combinations of the GTL 6 and the 150N/600N base oils. All contained 2.0 wt % (as received) dispersant Infineum C9268. The blends were tested in a soot handling screener is test which adds 3 wt % carbon black to the blend replicating 3 wt % soot in the oil.

The screener test is summarized below:

1. Prepared blend by adding designated amount of carbon black paste (20% carbon black) and test oil to a blender. Blend for 5 minutes at high speed.
2. Transfer mixture to beaker with magnetic stir bar. Stir at 200 rpm for 1 hour at 65° C.
3. Immediately after stirring, charge the mixture to the viscometer in the 100° C. KV bath. Allow sample to equilibrate for exactly 15 minutes, then measure the Kinematic viscosity.
4. For each oil, measure the viscosity increase at each increasing weight percent. Stop testing when viscosity increase exceeds 200%. In Example 1 the blends did not contain a viscosity modifier.

Results show that as more GTL is added, there is less increase in viscosity. Dispersancy, which relates to soot control capability, increases with increasing amounts of GTL:

TABLE 2

| % GTL | % Low S 150N | % 600N | Viscosity of base oil and dispersant blend, $mm^2/s$ | Viscosity with Carbon Black, $mm^2/s$ | % Viscosity increase with carbon black added as soot |
|---|---|---|---|---|---|
| 0.0 | 83.0 | 17.0 | 6.661 | 20.490 | 208% |
| 20.0 | 66.4 | 13.6 | 6.580 | 11.360 | 73% |
| 40.0 | 49.8 | 10.2 | 6.543 | 9.250 | 41% |
| 60.0 | 33.2 | 6.8 | 6.543 | 8.480 | 30% |
| 80.0 | 16.6 | 3.4 | 6.451 | 7.970 | 24% |
| 100.0 | 0.0 | 0.0 | 6.451 | 7.440 | 15% |

The results are presented graphically in FIG. 1.

Example 2

In this Example the relationship between GTL content and the desired thickening ability of two different viscosity modifiers at two different concentrations in blends is investigated. A 6.0 $mm^2/s$ GTL 6 and a 6.0 $mm^2/s$ Group I blend were used. No carbon black was added. The GTL/Group I base stock combinations used in Example 2 are the same as those used in Example 1 above.

TABLE 3

| | % GTL/% Group I Blend | | | | | |
|---|---|---|---|---|---|---|
| | 0/100 | 20/80 | 40/60 | 60/40 | 80/20 | 100/0 |
| Viscosity: Blend with 15 wt % (as received) Paratone 8011 ($mm^2/s$) | 16.0 | 15.5 | 15.2 | 14.8 | 14.5 | 14.2 |
| Thickening parameter: % Paratone 8011/change in KV100 | 1.50 | 1.57 | 1.64 | 1.70 | 1.77 | 1.82 |
| Viscosity: Blend with 25 wt % (as received) Infineum SVs 151 ($mm^2/s$) | 15.4 | 14.8 | 14.2 | 13.7 | 13.3 | 12.9 |
| Thickening parameter: % Shellvis 151/change in KV100 | 2.65 | 2.85 | 3.05 | 3.25 | 3.44 | 3.64 |

Larger ratios of % viscosity modifier to change in viscosity represent less thickening ability or solubilizing power of the base stock of the deliberately added viscosity modifier. Smaller values, i.e., lower ratio values are indicative of better thickening due to the viscosity modifiers. As more GTL is added, the thickening ability of the viscosity modifier in the blend decreases. The results are presented graphically in FIG. 2.

Figure 2:
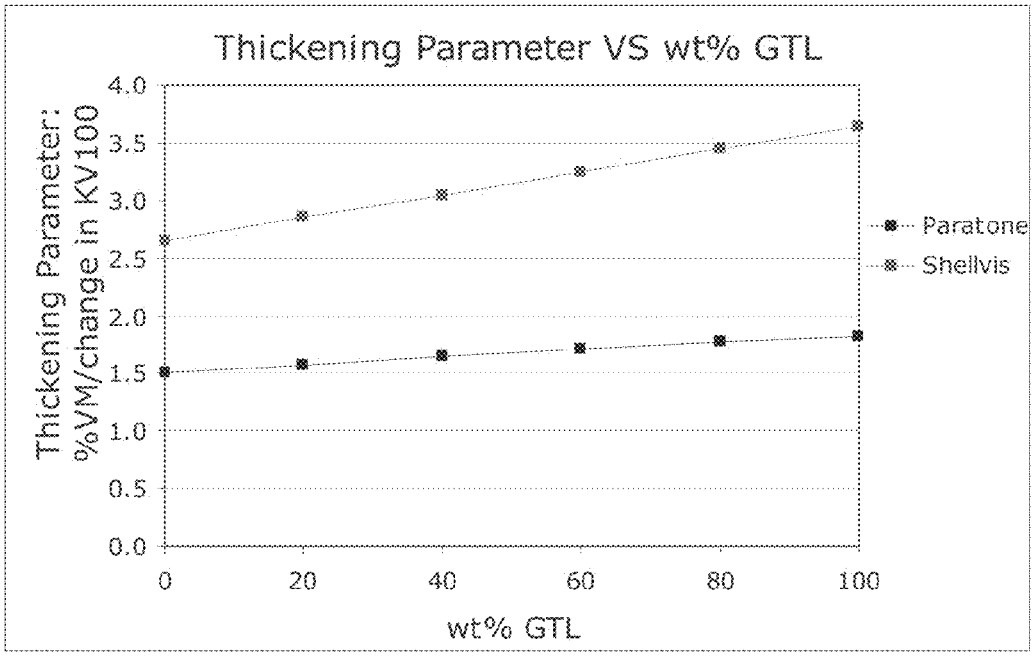
FIG. 2 shows the relationship between thickening ability attributable to Viscosity Modifier and the GTL content of the base oil.
Figure 3:
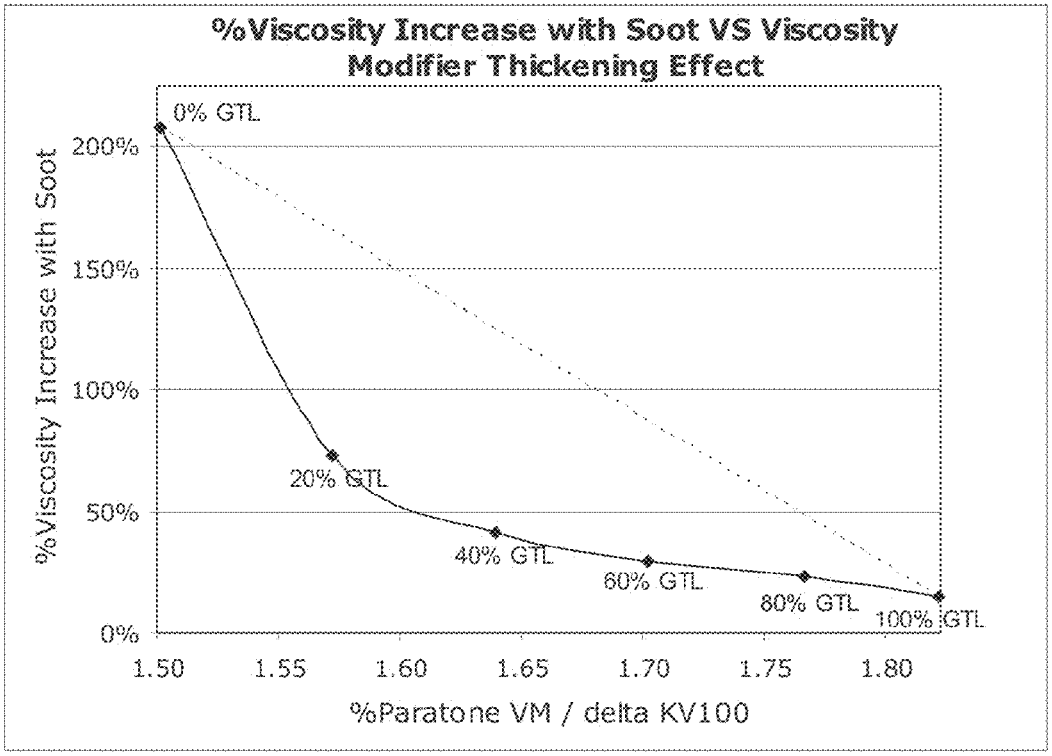
FIG. 3 shows the interrelationship between % viscosity increase due to soot and the thickening ability attributable to the viscosity modifier at different GTL levels in the base oil.

When one plots the % viscosity increase from FIG. 1/Table 2 against the polymer thickener parameter of FIG. 2/Table 3 one sees that there is an unexpected optional regime of GTL content within which one achieves not only a significant reduction in viscosity increase due to soot but still obtains the desirable thickening due to soot but still obtains the desirable thickening due to the viscosity modifiers. The results are presented in Table 4 and FIG. 3.

TABLE 4

| | % GTL/% Group I Blend | | | | | |
|---|---|---|---|---|---|---|
| | 0/100 | 20/80 | 40/60 | 60/40 | 80/20 | 100/0 |
| wt % Sulfur | 0.183 | 0.147 | 0.110 | 0.073 | 0.037 | 0.000 |
| % Viscosity Increase from Soot | 208% | 73% | 41% | 30% | 24% | 15% |
| Viscosity: Blend with 15 wt % (as received) Paratone 8011 (cSt) | 16.0 | 15.5 | 15.2 | 14.8 | 14.5 | 14.2 |
| % Paratone/ delta KV100 | 1.50 | 1.57 | 1.64 | 1.70 | 1.77 | 1.82 |

Blends containing between 10 and 80 wt % GTL in the base oil, preferably 20 to 60 wt % GTL in the base oil unexpectedly exhibited both a significant reduction in the viscosity increase due to soot in the oil Which retaining the desired thickening effect due to the viscosity modifier.

What is claimed is:

1. A method for controlling soot-induced viscosity increase experienced in diesel engine lubricating oils during use in diesel engines while not adversely affecting the viscosity-modifying effect of polymeric viscosity improvers included in the lubricating oil, the method comprising:

(a) employing as the diesel engine lubricating oil an oil formulation comprising a base oil blend consisting essentially of a Group I base stock, base oil or mixtures thereof and from about 20 to about 80 wt % of a GTL base stock or base oil; and (b) wherein said oil formulation includes about 15%, based on the total weight of the oil formulation of a polymeric viscosity-modifying additive comprising a copolymer of ethylene and propylene, which when used in said amount, provides the oil formulation with a % viscosity increase from soot of from about 24 to 73% and a thickening parameter in the range of about 1.57 to about 1.77.

2. The method of claim 1 wherein the base oil blend consists essentially of a mixture of Group I oils and said GTL oil.

3. The method of claim 2 wherein the mixture of Group I oils is a mixture of 150N and 600N Group I base oils.

4. The method of claim 3 wherein the Group I base oils has a kinematic viscosity at 100° C. in the range of about 4 to 8 $mm^2/s$.

5. The method of claim 4 wherein the mixture of Group I base oils has a kinematic viscosity at 100° C. of about 6.0 $mm^2/s$.

6. The method of claim 5 wherein the GTL oil has a kinematic viscosity at 100° C. in the range of about 3.5 to 30 $mm^2/s$.

7. The method of claim 6 wherein the GTL oil has a kinematic viscosity at 100° C. of about 6.0 $mm^2/s$.

8. A diesel engine oil composition comprising:

(a) a base oil consisting essentially of a Group I base stock, base oil or mixtures thereof and from about 20 to about 80 wt % of a GTL base stock or base oil; and (b) about 15 wt %, based on the total weight of the composition, of a polymeric viscosity additive comprising a copolymer of ethylene and propylene, which when included in said amount in said composition, provides the oil composition with a % viscosity increase from soot of from about 24 to 73% and a thickening parameter in the range of about 1.57 to about 1.77, whereby said composition under conditions of use displays control of soot-induced viscosity without adversely affecting the viscosity-modifying effect of the polymeric additive.

9. The composition of claim 8 wherein the base oil blend consists essentially of a mixture of Group I oils and said GTL oil.

10. The composition of claim 9 wherein the mixture of Group I oils is a mixture of 150N and 600N Group I base oils.

11. The composition of claim 10 wherein the Group I base oils has a kinematic viscosity at 100° C. in the range of about 4 to 8 $mm^2/s$.

12. The composition of claim 11 wherein the mixture of Group I base oils has a kinematic viscosity at 100° C. of about 6.0 $mm^2/s$.

13. The composition of claim 12 wherein the GTL oil has a kinematic viscosity at 1100° C. in the range of about 3.5 to 30 $mm^2/s$.

14. The composition of claim 13 wherein the GTL oil has a kinematic viscosity at 100° C. of about 6.0 $mm^2/s$.

* * * * *